United States Patent [19]

Braatvedt

[11] Patent Number: 4,544,515

[45] Date of Patent: Oct. 1, 1985

[54] METHOD FOR PRODUCING IN-SITU CONCRETED PILES WITH ENLARGED BASES

[75] Inventor: Ian H. Braatvedt, Liege, Belgium

[73] Assignee: Compagnie Internationale des Pieux Armes Frankignoul, Liege, Belgium

[21] Appl. No.: 545,948

[22] Filed: Oct. 27, 1983

[30] Foreign Application Priority Data

Nov. 5, 1982 [GB] United Kingdom ..... 8231681

[51] Int. Cl.[4] ..... E04B 1/16; E02D 5/44

[52] U.S. Cl. ..... 264/32; 405/237; 405/242; 405/243; 425/59

[58] Field of Search ..... 264/33, 32, 31, 34, 264/333; 405/232, 233, 242, 236, 237, 240, 243, 253, 269; 425/59

[56] References Cited

U.S. PATENT DOCUMENTS

| | | | |
|---|---|---|---|
| 1,477,567 | 12/1923 | Lancaster | 405/243 |
| 1,858,204 | 5/1932 | Frankignoul | 405/242 |
| 2,649,694 | 8/1953 | Pickman | 405/240 |
| 3,206,935 | 9/1965 | Phares | 405/243 |
| 3,512,365 | 5/1970 | Muller | 405/243 |
| 3,851,485 | 12/1974 | Steding | 405/233 |
| 4,012,915 | 3/1977 | Poma | 405/243 |
| 4,158,518 | 6/1979 | Rusche | 405/233 |

FOREIGN PATENT DOCUMENTS

| | | | |
|---|---|---|---|
| 1110092 | 6/1961 | Fed. Rep. of Germany | 405/242 |
| 2217485 | 8/1973 | Fed. Rep. of Germany | 405/233 |
| 470806 | 10/1914 | France | 405/242 |
| 862630 | 3/1961 | United Kingdom . | |
| 898635 | 6/1962 | United Kingdom . | |
| 1361182 | 7/1974 | United Kingdom . | |
| 1376460 | 12/1974 | United Kingdom . | |

*Primary Examiner*—Jay H. Woo
*Assistant Examiner*—James C. Housel
*Attorney, Agent, or Firm*—Brumbaugh, Graves, Donohue & Raymond

[57] ABSTRACT

A method and apparatus for producing in-situ concrete piles with enlarged bases. The method includes the steps of: driving into the ground a tube provided at its lower end with a shoe which is larger than the diameter of the tube, and with an outer casing attached around its lower portion; filling fresh concrete into the gap between the tube and the soil as fast as the opening in the soil is formed; expelling the shoe and a plug of concrete to form the enlarged base; and extracting the tube together with the outer casing.

5 Claims, 4 Drawing Figures

METHOD FOR PRODUCING IN-SITU CONCRETED PILES WITH ENLARGED BASES

The invention essentially relates to a method of and an apparatus for producing in-situ concreted piles with enlarged bases cast in the ground of the type wherein a tube is driven into the ground together with a shoe and a plug, an enlarged base is formed and concrete is cast within the tube.

Method and apparatus are already known in the prior art to drive a tube into the ground by means of a hammer of a pile driver and to form an enlarged base by expelling a plug of concrete or other resistant materials out of the lower end of the tube. When the enlarged base is of sufficient size and the surrounding material has been sufficiently compacted to support the required load, steel reinforcement and concrete are placed in the tube and the tube is extracted concurrent with certain vibratory forces or direct blows being applied to the tube. This ensures denseness of the concrete which occupies the space vacated by the tube as it is extracted. In this method and apparatus, the extraction of the tube is very difficult due to the forces and pressure applied by the soil against the tube. Moreover, it requires the use of a tube of the same diameter as the desired diameter of pile.

It is an object of this invention to provide a method of and apparatus for producing a concrete pile cast in the ground which overcomes all these drawbacks.

For this purpose, the present invention provides a method for producing a concrete pile with enlarged base cast in the ground cavity consisting in driving into the ground by means for example of an automative pile driver having a free-falling hammer, a tube provided at its lower end with a shoe and a plug of concrete or other resistant materials, when said shoe has reached the material in which the said enlarged base is to be formed, in expelling the shoe and the plug by successive blows of a hammer to form said enlarged base, in filling the tube with fresh concrete and extracting the tube, characterized in that it consists in forming a gap between the soil and the tube by driving into the ground said shoe which is larger than the diameter of said tube, in filling fresh concrete in said gap as fast as this gap is formed, and after the enlarged base is formed, in lifting the tube to allow fresh concrete to enter into the tube through its lower end, and extracting the tube while concrete is filled in said gap to always maintain the gap filled.

According to another characteristic of the invention, the tube is driven into the ground by successive blows of said hammer on said plug, and when the shoe has reached said material in which the enlarged base is to be formed, the plug and the shoe are expelled by successive blows of the hammer while the tube is maintained at a constant level by means of traction cables attached to its upper end.

According to another characteristic of the invention, an outer casing is attached to said tube, around the lower part thereof, said casing has a diameter substantially equal to the size of said shoe.

Advantageously, said outer casing is attached to the tube with a sliding joint to permit the tube to be lifted ahead of the outer casing in order to allow concrete to enter into the tube. This outer casing has a length equal to four times the diameter of the shoe.

According to another aspect of the invention, there is provided an apparatus for carrying out the preceding method and comprising a tube, a shoe attached to the lower end of said tube, an automative pile driver having a free-falling hammer for driving said tube into the ground, means for supplying concrete, characterized in that said shoe is larger than diameter of said tube and it comprises means of traction cables attached to the upper end of said tube.

Besides, an outer casing is attached to the tube around the lower portion thereof.

Other characterizing features, advantages and details will appear more clearly from the following description made with reference to the appended drawings given solely by way of example and wherein.

Figure 1:
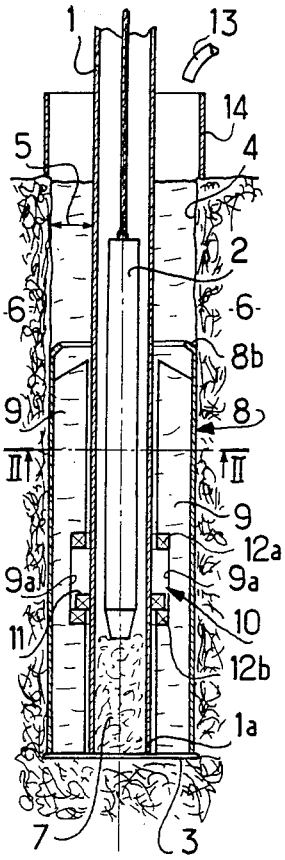
FIG. 1 is a diagrammatical view in section of the apparatus of the invention during the driving of the tube into the ground, the pile driver being not illustrated.
Figure 2:
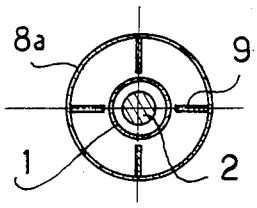
FIG. 2 is a view in section according to line II—II of the FIG. 1.

The apparatus diagrammatically illustrated in FIGS. 1, 2 comprises a tube 1, a free-falling hammer 2 which is in the tube 1. This hammer 2 is advantageously supported and actuated by an automative pile driver (not illustrated).

To the lower end 1*a* of the tube 1 is attached a shoe 3. This shoe can be in the shape of a disc or a point or other shapes.

According to the invention, the size, such as for example the diameter, of the shoe 3 is larger than the diameter of tube 1. Therefore, when the tube is driven into the ground to form the opening 4, a gap 5 is formed between the tube 1 and the soil 6.

Prior to boring of the pile casting hole, the tube 1 has its lower end fitted with a substantially hermetic sealing plug 7 which is inserted into the lower extremity of the tube 1. This plug may consist of concrete or other resistant materials such as wood, metal or the like.

According to the preferred embodiment of the invention, an outer casing 8 is attached to the tube 1 around the lower portion thereof. This casing is a cylindrical tube 8*a* of a diameter substantially equal to the diameter of the shoe 3 and provided with, for example, four vertical internal bars or plates 9 as illustrated in FIG. 2.

This outer casing 8 is attached to the tube 1 through a sliding joint 10. This sliding joint 10 is formed by notches 9*a* provided on each bar 9 and an annular ring 11 fixed around the tube 1. The annular ring 11 can slide within the notches 9*a* of bars 9. Moreover, each notch 9*a* is provided, on each lateral edge, with an annular ring 12*a*,12*b*.

Advantageously, the upper end of the outer casing 8 is provided with an inward flange 8*b*.

Of course, the number of rings, the structure of the sliding joint are given solely for example.

Figure 3:
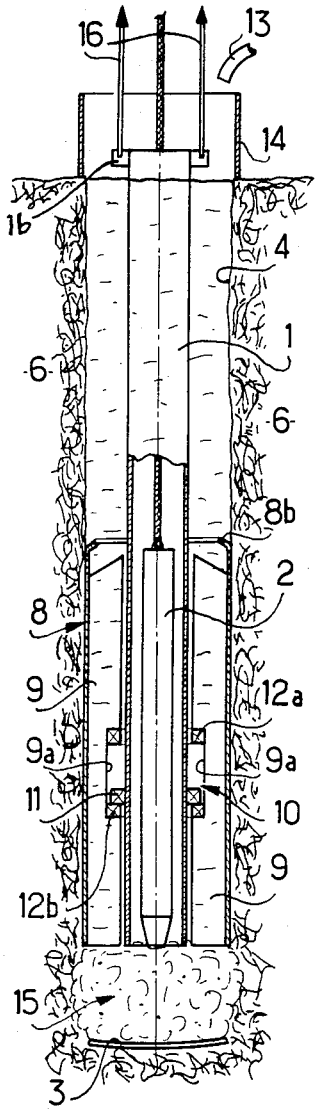
FIG. 3 is a view analogous to that of FIG. 1, showing the cast pile during the formation of the enlarged base.
Figure 4:
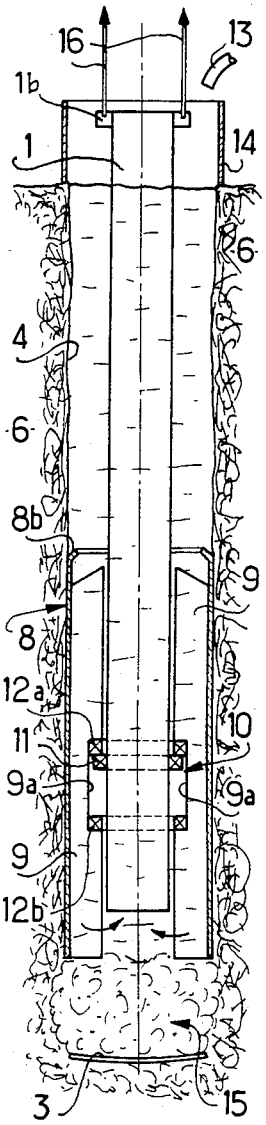
FIG. 4 is a view analogous to that of FIG. 1 or 3 showing the final stage in the production of the cast pile of the invention, and more particularly the extraction of the tube.

Referring to FIGS. 1, 3 and 4, the method of the invention for producing in-situ a concreted pile with an enlarged base with the apparatus which has been described, is now explained.

The tube 1 with the shoe 3, the plug 7 and the outer casing 8 is driven into the ground by successive blows of the hammer 2 on the plug 7, the plug being controlled by, for example, an automative pile driver.

During the driving of the tube into the ground, the opening 4 is formed and also the gap 5 between the tube 1 and the soil 6 or the outer casing 8.

According to the invention, this gap is filled with fresh concrete as fast as this gap is formed by supplying means 13. Consequently, since the gap 5 is always full with fresh concrete, this fact prevents caving in the walls of the opening 4 if it is formed in unstable ground.

It is important, during the driving of the tube 1 into the ground, that the fresh concrete supplied into the gap 5 cannot flow into the tube 1.

In the preferred embodiment of the invention, a temporary casing 14 is placed on the ground around the opening 4 to permit a suitable supplying of fresh concrete in the gap 5 from the supplying means 13.

Furthermore, it is judicious to maintain substantially constant, the level of fresh concrete in the gap 5 in order to maintain this gap entirely filled. The outer casing 8 is provided to prevent the "necking" or the reduction of shaft diameter which occurs in accordance with well known geotechnical principles during the forming of the opening in the ground. More preferably, the length of this outer casing is equal to four times the diameter of the shoe 3.

The further stage of the method of the invention, illustrated in FIG. 3, consists in forming the enlarged base 15 of the pile.

When the shoe 3 has reached the material in which the enlarged base 15 is to be formed, the tube 1 is maintained in position by means of traction cable 16 attached to its upper end 1*b* and preferably actuated by the pile driver. Then, the shoe 3 and the plug 7 is expelled and compacted by successive blows of the hammer 2. This compacting of the plug 7 is a result of compacting the soil around the base of the tube 1. A widened base of the pile which is to be formed, is thus produced and this widened base being formed by compacted concrete or other resistant materials which is itself placed in a rammed and compacted area of the soil.

FIG. 4 illustrates the following stage of the method of the present invention. In this stage, the hammer is at first withdrawn and a metal reinforcement (not illustrated) may be placed within the tube 1.

The tube 1 is then lifted ahead of the outer casing 8 by sliding of the annular ring 11 in the notch 9*a* to allow fresh concrete contained in the gap 5 to enter through the bottom of the tube 1 and fill this tube 1. Of course, fresh concrete is continuously supplied into the gap 5, by supplying means, to maintain substantially constant, the level of the concrete in the gap 5.

The tube is further extracted from the ground by means of traction cables 16 together with the associated outer casing 8 to form the pile.

Since the tube 1 is entirely contained in a fresh concrete, thus, the extraction of this tube requires reduced forces.

Besides, the use of a shoe which is larger than the diameter of the tube 1 permits the use of a tube of small diameter. The filling of the gap 5 with fresh concrete during the driving of the tube into the ground and the formation of the enlarged base, and the use of an outer casing prevent caving in the walls of the opening, "necking" and reduction of shaft diameter.

What we claim is:

1. A method for producing a concrete pile with an enlarged base, comprising the steps of:

providing a tube carrying at its lower end a shoe having a larger diameter than the tube for forming a gap between the tube and the ground, and an outer casing of a diameter substantially equal to the diameter of the shoe so that a space is left between the tube and the outer casing, said outer casing being slidably attached to the tube by a sliding joint that allows a predetermined length of relative sliding between the tube and the outer casing, said outer casing having a lower end attached to the shoe and an upper end open to permit free flow of concrete within said space, driving the tube, with outer casing attached, into the ground to a depth greater than the length of the outer casing, thereby forming an opening in the ground and defining the gap between the tube and the ground, filling the gap and the space with concrete as the tube with attached outer casing is driven into the ground, when the shoe has reached a desired depth, expelling the shoe and from the lower end of the tube and the outer casing, along with some of the concrete, so as to form an enlarged base, after said enlarged base is formed, raising the tube away from the shoe, thereby causing at first a sliding of said tube with respect to said outer casing which allows concrete from said space to enter the volume of space previously occupied by the lower end to the tube, and thereafter removing both the tube and the outer casing from the ground and allowing concrete from the gap and space to fill the opening to form the pile.

2. The method of claim 1, wherein the outer casing has a length substantially equal to four times the diameter of the shoe.

3. The method of claim 1, comprising the further step of supplying concrete to the gap so as to maintain the level of concrete in the gap.

4. The method of claim 1, comprising the further steps of providing a plug within the tube at the lower end thereof, and when the shoe has reached the desired depth, expelling the plug with the shoe.

5. The method of claim 4 wherein the tube is driven into the ground by successive blows of a hammer on the plug, and wherein the shoe and plug are expelled by successive blows on the plug while the tube is maintained at a substantially constant level by traction cables.

* * * * *